US010431907B2

(12) United States Patent
Karpe

(10) Patent No.: US 10,431,907 B2
(45) Date of Patent: Oct. 1, 2019

(54) CONNECTION APPARATUS AND ELECTRICAL RECEPTACLE

(71) Applicant: EATON CORPORATION, Cleveland, OH (US)

(72) Inventor: Raj Ashok Karpe, Maharashtra (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/851,841

(22) Filed: Dec. 22, 2017

(65) Prior Publication Data

US 2019/0199009 A1 Jun. 27, 2019

(51) Int. Cl.

| | |
|---|---|
| ***H01R 4/36*** | (2006.01) |
| ***H01R 24/78*** | (2011.01) |
| *H01R 13/11* | (2006.01) |

(52) U.S. Cl.

CPC ..... *H01R 4/36* (2013.01); *H01R 24/78* (2013.01); *H01R 13/113* (2013.01); *H01R 13/114* (2013.01)

(58) Field of Classification Search

USPC ..... 439/801, 765, 810, 856, 857

See application file for complete search history.

(56) References Cited

U.S. PATENT DOCUMENTS

| | | | | |
|---|---|---|---|---|
| 4,944,700 | A * | 7/1990 | Simon | H01R 4/30 439/801 |
| 7,503,800 | B2 * | 3/2009 | Siglock | H01R 4/36 439/517 |
| 7,731,545 | B1 * | 6/2010 | Scholeno | H01R 33/05 439/619 |
| 8,795,006 | B2 * | 8/2014 | Hoffman | H01R 4/363 439/811 |
| 8,986,054 | B2 * | 3/2015 | Stadler | H01R 4/489 439/801 |
| 8,998,657 | B1 * | 4/2015 | Von Eckroth | H01R 13/114 439/810 |
| 9,625,173 | B2 * | 4/2017 | Adamik | F24F 11/30 |
| 9,647,402 | B2 * | 5/2017 | Lee | H01R 24/78 |

* cited by examiner

*Primary Examiner* — Tho D Ta

(74) *Attorney, Agent, or Firm* — Eckert Seamans Cherin & Mellott, LLC

(57) ABSTRACT

A connection apparatus that is usable with an electrical receptacle includes a screw that is threadably situated on a conductive device. The conductive device is formed from an individual metallic plate and thus is co-formed as a single piece unit.

20 Claims, 4 Drawing Sheets

CONNECTION APPARATUS AND ELECTRICAL RECEPTACLE

BACKGROUND

Field

The disclosed and claimed concept relates generally to electrical equipment and, more particularly, to an electrical receptacle and a connection apparatus used therein.

Related Art

Numerous types of electrical connectors are known in the relevant art. Electrical connectors typically are employed in order to electrically connect together two electrical conductors. Some electrical connectors are configured to enable the two electrical conductors to be detachably connected with one another in order to permit rapid electrical connection and disconnection, if desired.

One such type of electrical connector is used in an electrical receptacle such as is mounted to a wall and is electrically connected with wires that are situated internal to the wall and which employs a screw or other threaded fastener to form the electrical connection between the wire and the electrical connector. The electrical connector typically includes a terminal portion upon which the screw is mounted and a spring-like conductor portion upon which the terminal is mounted and which is configured to receive an electrically conductive blade of an electrical appliance in electrical connection therewith. While such electrical connectors have been generally effective for their intended purposes, they have not been without limitation.

Such electrical connectors typically include numerous components that are connected together, either mechanically or with the use of solder and the like. The cost and time required to manufacture such connectors has correspondingly been excessive. Improvements thus would be desirable.

SUMMARY

An improved connection apparatus that is usable with an electrical receptacle includes a screw that is threadably situated on a conductive device. The conductive device is formed from an individual metallic plate and thus is co-formed as a single piece unit.

Accordingly, an aspect of the disclosed and claimed concept is to provide a connection apparatus that includes a conductive device that is formed from an individual metallic plate and a screw that is received on the conductive device.

Another aspect of the disclosed and claimed concept is to provide a method of forming a connection apparatus that includes bending an individual metallic plate to form a conductive device and receiving a compression element such as a screw on the conductive device.

Accordingly, an aspect of the disclosed and claimed concept is to provide an improved connection apparatus structured to be electrically connected with a wire and with an electrical connector. The connection apparatus can be generally stated as including a conductive device, a compression element situated on the conductive device, the conductive device can be generally stated as including a pair of contacts and a terminal co-formed with one another from a single sheet of material, the terminal can be generally stated as including a base and a support, the support extending in a direction from the base, the compression element being disposed on the support and being structured to be movable toward and away from the base and being further structured to compressively retain the wire between the compression element and the base, and the pair of contacts being structured to receive the electrical connector therebetween and to be biased into mechanical and electrical engagement with the electrical connector.

Another aspect of the disclosed and claimed concept is to provide an improved method of forming a connection apparatus that is structured to be electrically connected with a wire and with an electrical connector. The method can be generally described as including bending an individual metallic plate to form a conductive device having a number of plate elements wherein at least one plate element of the number of plate elements is a base of a terminal of the conductive device, at least a further plate element of the number of plate elements is a support of the terminal of the conductive device, the support extending from the base, and at least a pair of plate element of the number of plate elements is a pair of contacts of the conductive device, the pair of contacts extending from the terminal and being structured to receive the electrical connector therebetween and to be biased into mechanical and electrical engagement with the electrical connector, and receiving on the support a compression element that is structured to be movable toward and away from the base and that is further structured to compressively retain an electrical conductor between the compression element and the base.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 1:
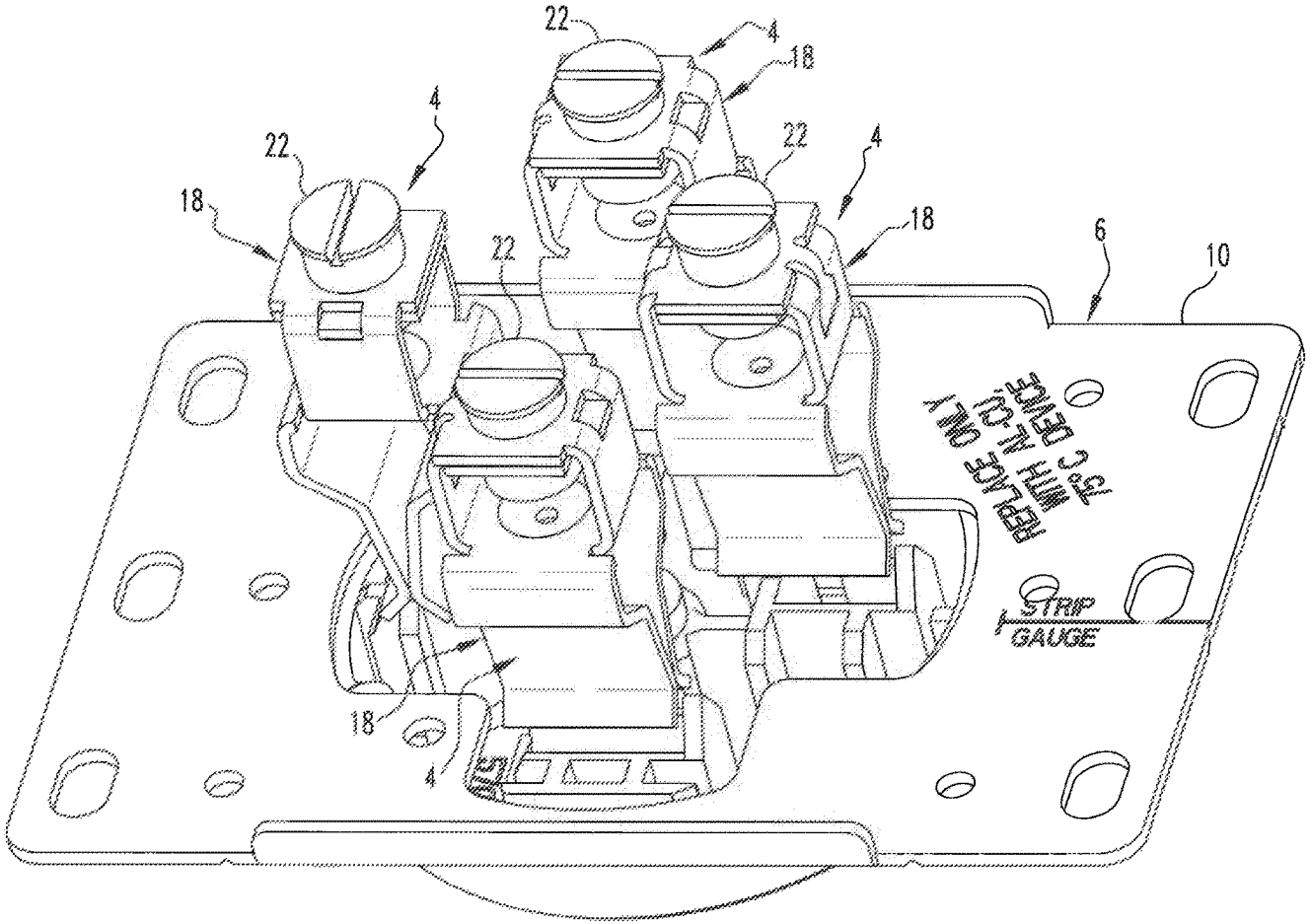
FIG. 1 is a perspective view of an improved connection apparatus in accordance with the disclosed and claimed concept situated on an electrical receptacle in accordance with the disclosed and claimed concept.
Figure 6:
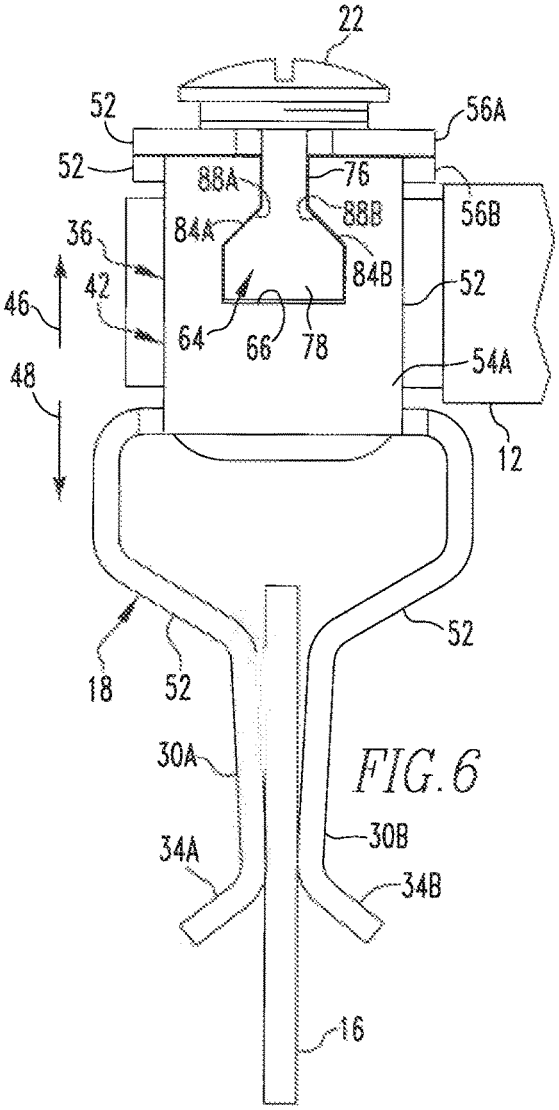
FIG. 6 is a view similar to FIG. 5, except depicting the conductive device having a screw situated thereon that connects a wire with the conductive device and further depicting a blade electrical connector received between a pair of contacts of the conductive device.

A plurality of instances of an improved connection apparatus 4 in accordance with the disclosed and claimed concept are depicted in FIG. 1 as being a part of an electrical receptacle 6 such as is intended to be mounted to a wall and be connected with wires that are situated within the wall. The electrical receptacle 6 includes a wall plate 10, and the instances of the connection apparatus 4 are situated on the wall plate 10. As will be set forth in greater detail, and as can be seen in FIG. 6, the connection apparatus 4 is connectable with a wire 12, such as one that is situated within the wall, and the connection apparatus 4 is further configured to be electrically connectable with a blade electrical conductor 16. It thus can be understood that the connection apparatus 4 facilitates an electrical connection between the wire 12, such as may be connected with an electrical utility, and the blade 16, such as may be electrically connected with an electrical load. In the depicted exemplary embodiment of FIG. 1, the electrical receptacle 6 includes four instances of the connection apparatus 4, i.e., one for a line, one for a neutral, and two for grounds, by way of example.

Figure 2:
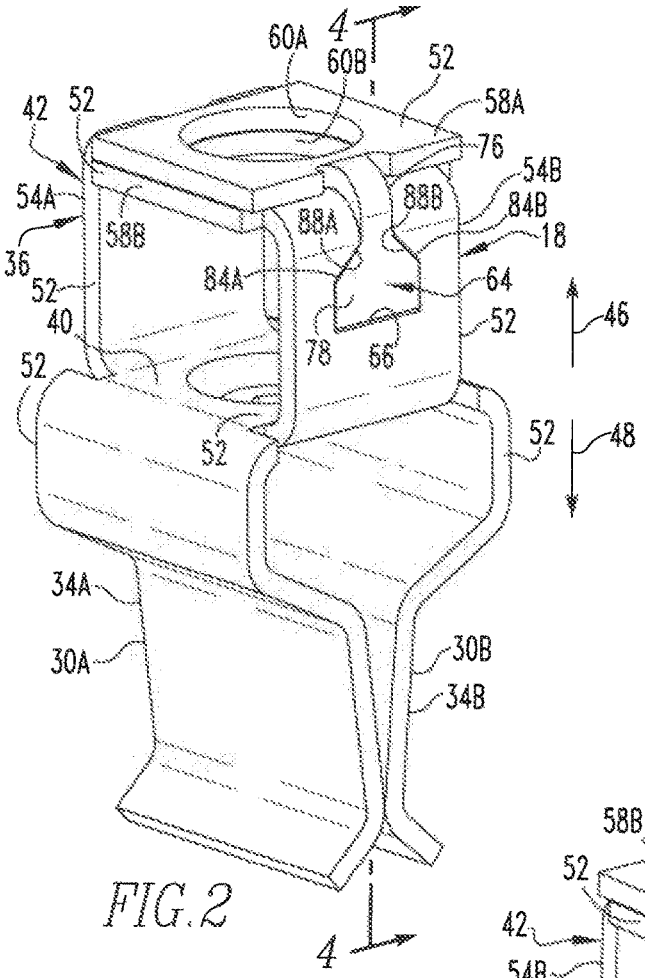
FIG. 2 is a perspective view of a conductive device of the connection apparatus of FIG. 1.
Figure 3:
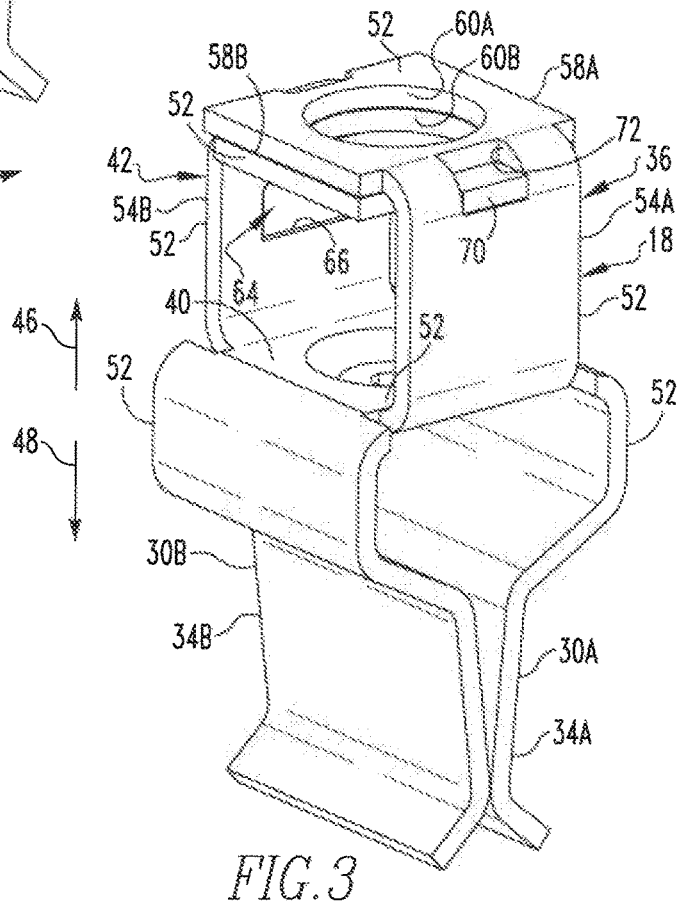
FIG. 3 is another perspective view of the conductive device.
Figure 5:
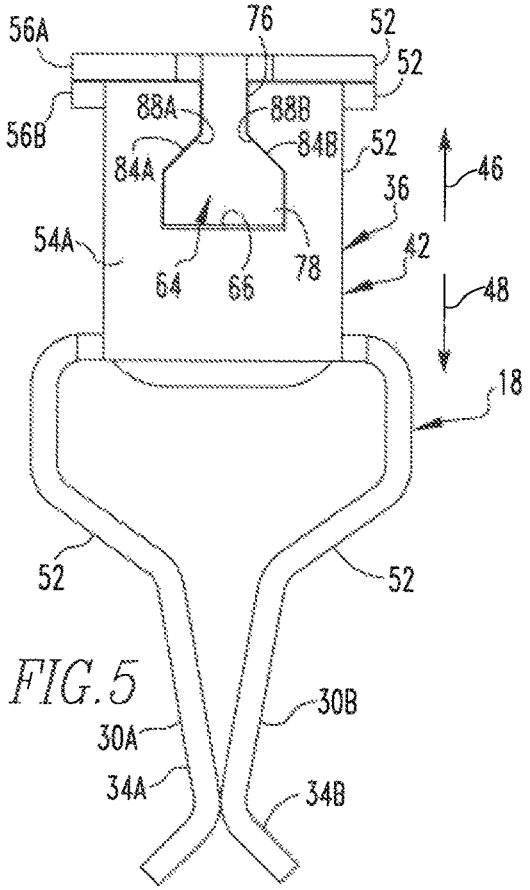
FIG. 5 is an end view of the conductive device.

As can be understood from FIGS. 1 and 6, the connection apparatus 4 can be said to include a conductive device 18, such as is depicted in FIGS. 2, 3, and 5, and a screw 22 that is threadably situated on the conductive device 18 and that is depicted in FIGS. 1 and 6. As will likewise be set forth in greater detail below, the screw 22 serves as a compression element that is operable to compressively retain the wire 12 between the screw 12 and the conductive device 18.

Figure 7:
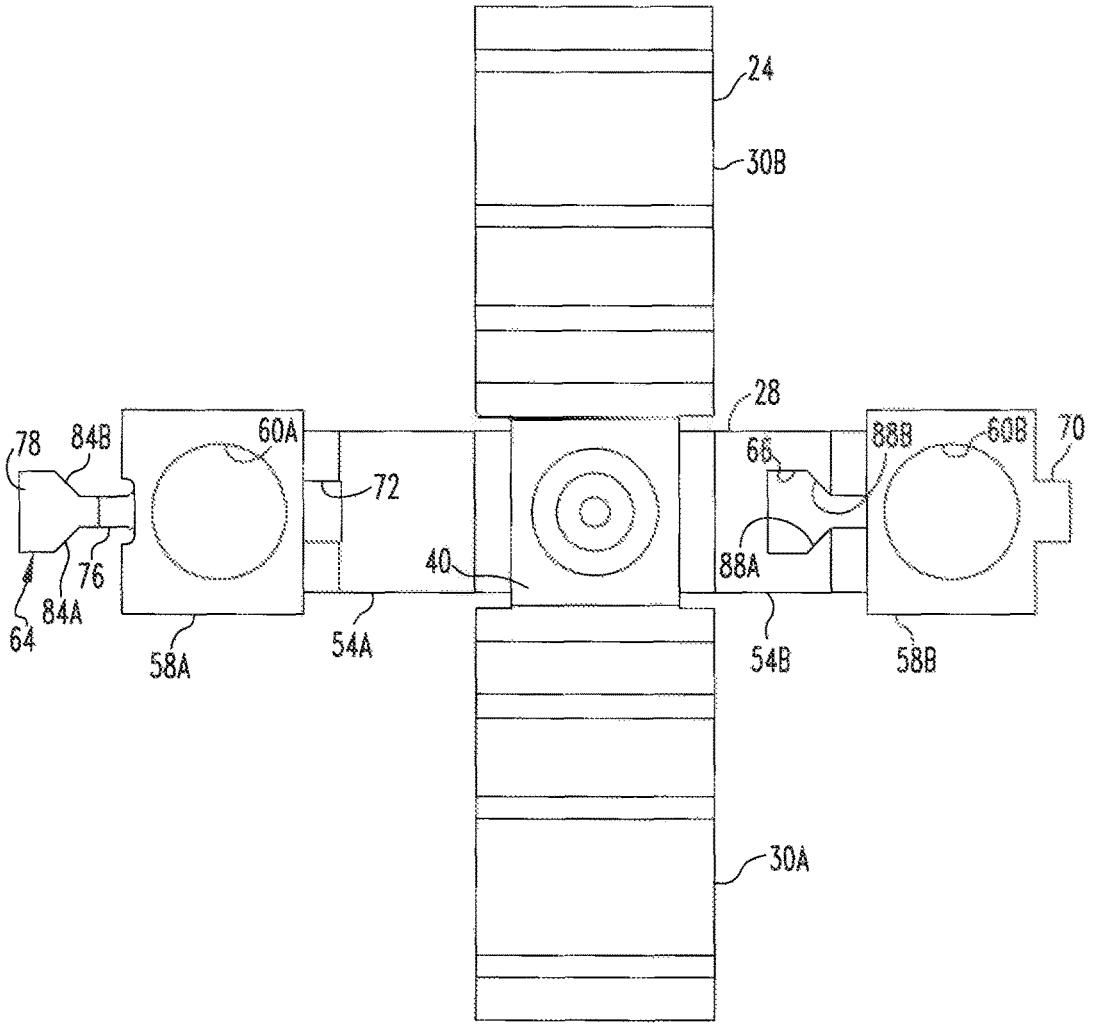
FIG. 7 is a view of an individual metallic plate that is bent to form the conductive device of FIGS. 1-6.

The conductive device 18 is advantageously formed from an individual metallic plate 24, such as is depicted generally in FIG. 7. That is, the individual metallic plate 24 that is depicted in FIG. 7 is a single piece of material that is bent to form the conductive device 18 such as is depicted generally in FIGS. 2, 3, and 5. As can be understood from FIG. 7, the individual metallic plate is of a generally cruciform shape that includes a body 28 that is elongated and a pair of wings that are indicated at the numerals 30A and 30B, and which may be collectively or individually referred to herein with the numeral 30, which extend in opposite directions away from the body 28. By forming the conductive device 18 out of the individual metallic plate 24, the conductive device 18 is formed as a unitary single piece structure.

As can be understood from FIGS. 2-6, the conductive device 18 can be said to include a pair of contacts that are indicated at the numerals 34A and 34B, and which may be collectively or individually referred to herein with the numeral 34. The contacts 34A and 34B are biased into engagement with one another and are biased into electrical engagement with the blade 16 when the blade 16 is received therebetween. The conductive device 18 further includes a terminal 36, with the pair of contacts 34 being mounted on the terminal 36. More specifically, the terminal 36 can be said to include a base 40 on which the pair of contacts 34 are situated and a support 42 that extends away from the base 40 in a first direction 46. The pair of contacts 34 can be said to extend in a second direction 48 away from the base 40, with the first and second directions 46 and 48 being opposite one another. The screw 22 can be said to be threadably movable toward and away from the base 40 along the first and second directions 46 and 48 in order to compressively engage the wire 12 between the screw 22 and the base 40 to thereby electrically connect together the wire 12 and the conductive device 18.

In forming the conductive device 18 out of the individual metallic plate 24 of FIG. 7, the individual metallic plate 24 is bent by any of a variety of metal forming operations to form the conductive device 18 into a number of plate elements that are generally indicated at the numeral 52 in FIGS. 2-6. As employed herein, the expression "a number of" and variations thereof shall refer broadly to any non-zero quantity, including a quantity of one. For instance, the number of plate elements 52 can be said to include a pair of lugs 54A and 54B, which may be collectively or individually referred to herein with the numeral 54, and to further include a pair of platforms 58A and 58B, and which may be collectively or individually referred to herein with the numeral 58, all of which are portions of the support 42. The lugs 54 are first portions of the wings 30 and retain the platforms 58 at a location spaced from the base 40. The platforms 58 overlie one another and constitute second portions of the wings 30. It thus can be seen that the lugs 54, i.e., the first portions of the wings 30, are situated between the base 40 and the platforms 58, i.e., the second portions of the wings 30, on each of the wings 30A and 30B. When the conductive device 18 is formed from the individual metallic plate 24, the platform 58A overlies the platform 58B, and the platform 58B thus is situated between the platform 58A and the base 40.

Figure 4:
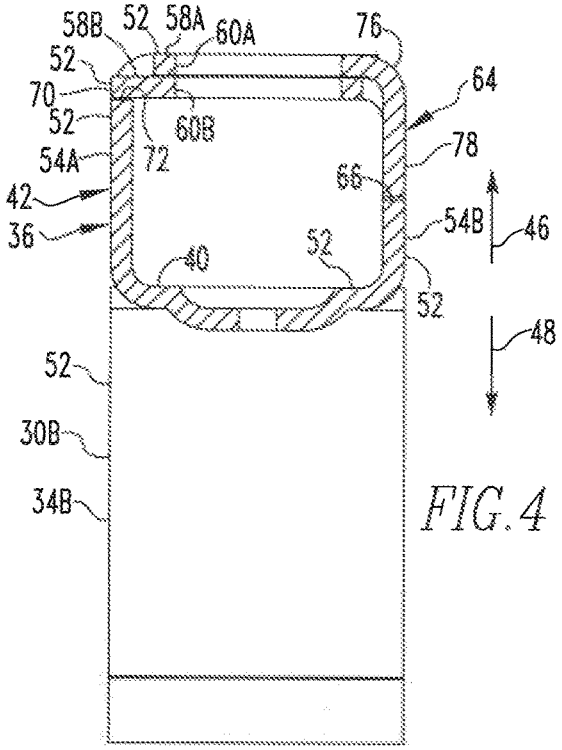
FIG. 4 is a sectional view as taken along lone 4-4 of FIG. 2.

As is best shown in FIGS. 2-4, the platform 58A has a hole 60A formed therein, and the platform 58B has a hole 60B formed therein, it being understood that the holes 60A and 60B may be collectively or individually referred to herein with the numeral 60. When the conductive device 18 is formed from the individual metallic plate 24, the holes 60 are aligned with one another inasmuch as the platforms 58 overlie one another. After such formation of the conductive device 18 by bending the individual metallic plate 24, the holes 60 are then threaded in order to enable the screw 22 to be threadably cooperable therewith.

As is best shown in FIG. 2, the conductive device 18 further includes a first latch 64 that is received in a first receptacle 66. As is best shown in FIG. 3, the conductive device 18 additionally includes a second latch 70 that is received in a second receptacle 72.

The first latch 64 can be said to include a neck 76 that extends from an end of the platform 58A opposite the lug 54A and to further include a bolt 78 that is situated at an end of the neck 76 opposite the platform 58A. The bolt 78 is received in the first receptacle 66, and it can be seen that the first receptacle 66 is formed in the lug 54B of the wing 30B. The first latch 64 includes a pair of engagement edges 84A and 84B, which may be collectively or individually referred to herein with the numeral 84, which are oriented oblique to one another and which together are of an approximately wedge-like shape. As employed herein, the expression "oblique" shall refer broadly to a relationship that is neither parallel nor perpendicular. The first receptacle 66 is likewise formed to include a pair of abutment edges that are indicated at the numerals 88A and 88B, and which may be collectively or individually referred to herein with the numeral 88, which are oriented oblique to one another and which together are of an approximately wedge-like shape.

As can be understood from FIGS. 2, 5, and 6, the engagement edges 84 of the first latch 64 and, more specifically, of the bolt 78, are received against the abutment edges 88 when the conductive device 18 is assembled, thereby resisting movement of the platform 58A away from the base 40. This is advantageous inasmuch as the compressive force applied by the screw 22 to the wire 12 results in a reaction force being applied by the screw 22 to the platform 58 in the first direction 46. Such reaction force is advantageously resisted by the compressive engagement of the engagement edges 84 with the abutment edges 88.

It is understood that another such reaction force in the first direction 46 is applied by the screw 22 to the platform 58B when the screw 22 compressively engages the wire 12 between it and the base 40. It can be seen that the second receptacle 72 is formed in the lug 54A of the wing 30A, and the reception of the second latch 70 in the second receptacle 72 resists such reaction force applied to the platform 58B by the screw 22.

By forming the conductive device 18 out of the individual metallic plate 24, costs savings can be realized due to the avoidance of any need to mechanically attach together the terminal 36 and the pair of contacts 34. Such cost is avoided because the terminal 36 and the pair of contacts 34 are already co-formed together as a single piece unitary structure inasmuch as they are formed from plate elements 52 of the individual metallic plate 24. The provision of the first and second latches 64 and 70 received in the first and second receptacles 66 and 72, respectively, resists the platforms 58A and 58B from being deformed to an extent that the conductive device 18 would become unusable, and the avoidance of such deformation is advantageous. The formation of the first receptacle in the wing 30B and the formation of the second receptacle 72 in the wing 30A enables the wings 30A and 30B and, more specifically, the lugs 54 and the platforms 58 of the terminal 36 to be cooperable with one another to resist plastic deformation of the terminal 36 when the screw 22 is tightened against the wire 12 that is received against the base 40. The connection apparatus 4 is thus advantageously reliable and is cost effective. Other benefits will be apparent.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A connection apparatus structured to be electrically connected with a wire and with an electrical connector, the connection apparatus comprising:

a conductive device;

a compression element situated on the conductive device;

the conductive device comprising a pair of contacts and a terminal co-formed with one another from a single sheet of material;

the terminal comprising a base and a support, the support extending in a direction from the base;

the compression element being disposed on the support and being structured to be movable toward and away from the base and being further structured to compressively retain the wire between the compression element and the base; and the pair of contacts being structured to receive the electrical connector therebetween and to be biased into mechanical and electrical engagement with the electrical connector.

2. The connection apparatus of claim 1 wherein the pair of contacts are situated on the base and extend from the base in another direction opposite the direction.

3. The connection apparatus of claim 1 wherein the sheet of material comprises an individual metallic plate bent to form in the conductive device a number of plate elements, the base comprising at least one plate element of the number of plate elements, the pair of contacts each comprising at least another plate element of the number of plate elements, and the support comprising at least a further plate element of the number of plate elements.

4. The connection apparatus of claim 3 wherein the support comprises as the at least further plate element a plurality of plate elements, at least a pair of plate elements of the plurality of plate elements overlying one another and each having a hole formed therein that is structured to receive the compression element.

5. The connection apparatus of claim 4 wherein the holes are aligned with one another and are threaded, the holes being structured to threadably receive the compression element.

6. The connection apparatus of claim 4 wherein the plate comprises a body that is elongated and further comprises a first wing and a second wing, the first and second wings extending from opposite sides of the body, the first and second wings each having a first portion and a second portion wherein the first portion is disposed between the body and the second portion, the second portions being the at least pair of plate elements of the conductive device and each having the hole formed therein.

7. The connection apparatus of claim 6 wherein the first portions are a pair of parallel and spaced apart lugs of the conductive device that extend between the base and the at least pair of plate elements and that retain the at least pair of plate elements spaced apart from the base.

8. The connection apparatus of claim 6 wherein the body, the first wing, and the second wing together give the plate a generally cruciform shape.

9. The connection apparatus of claim 8 wherein the base is a portion of the body and is disposed between the first wing and the second wing.

10. The connection apparatus of claim 6 wherein one of the first wing and the second wing comprises a latch, the other of the first wing and the second wing having a receptacle formed therein, at least a portion of the latch being received in the receptacle to resist movement of the second portions away from one another when the compression element compressively retains the wire between the compression element and the base.

11. The connection apparatus of claim 10 wherein the latch comprises a neck that extends from the second portion of the one of the first wing and the second wing and a bolt that is situated on the neck opposite the second portion of the one of the first wing and the second wing, the bolt being received in the receptacle.

12. The connection apparatus of claim 11 wherein a portion of the bolt adjacent the neck has a pair of engagement edges that are oriented oblique to one another to be of a wedge-like shape, and wherein a portion of the receptacle includes a pair of abutment edges that are oriented oblique to one another to be of a corresponding wedge-like shape and that are structured to receive against them the pair of engagement edges.

13. The connection apparatus of claim 10 wherein the other of the first wing and the second wing comprises another latch, the one of the first wing and the second wing having another receptacle formed therein, at least a portion of the another latch being received in the another receptacle to further resist movement of the second portions away from one another when the compression element compressively retains the wire between the compression element and the base.

14. The connection apparatus of claim 13 wherein the another latch extends from the second portion of the other of the first wing and the second wing, the second portion of the other of the first wing and the second wing being situated between the base and the second portion of the one of the first wing and the second wing.

15. A method of forming a connection apparatus that is structured to be electrically connected with a wire and with an electrical connector, the method comprising:

bending an individual metallic plate to form a conductive device having a number of plate elements wherein:

at least one plate element of the number of plate elements is a base of a terminal of the conductive device, at least a further plate element of the number of plate elements is a support of the terminal of the conductive device, the support extending from the base, and at least a pair of plate element of the number of plate elements is a pair of contacts of the conductive device, the pair of contacts extending from the terminal and being structured to receive the electrical connector therebetween and to be biased into mechanical and electrical engagement with the electrical connector, and receiving on the support a compression element that is structured to be movable toward and away from the base and that is further structured to compressively retain an electrical conductor between the compression element and the base.

16. The method of claim 15, further comprising employing as the plate an individual and generally cruciform shaped plate-like conductive element having a body that is elongated and a first wing and a second wing that extend from opposite sides of the body, the first and second wings each having a first portion and a second portion wherein the first portion is disposed between the body and the second portion, the second portions being the at least further plate element of the conductive device and each having a hole formed therein.

17. The method of claim 16, further comprising deforming the first and second wings to align the holes with one another, and forming threading on the holes subsequent to the deforming.

18. The method of claim 16, further comprising deforming the first and second wings to cause the second portions to overlie one another with the holes being aligned with one another.

19. The method of claim 18, further comprising forming one of the first wing and the second wing to have a latch, forming the other of the first wing and the second wing to have a receptacle formed therein, and receiving at least a portion of the latch in the receptacle to resist movement of the second portions away from one another when the compression element compressively retains the wire between the compression element and the base.

20. An electrical receptacle comprising the connection apparatus of claim 1, the electrical receptacle further comprising:

a wall plate, the connection apparatus being situated on the wall plate.

* * * * *